US011651878B2

(12) United States Patent
Mogi et al.

(10) Patent No.: US 11,651,878 B2
(45) Date of Patent: May 16, 2023

(54) GRAIN-ORIENTED ELECTRICAL STEEL SHEET

(71) Applicant: NIPPON STEEL CORPORATION, Tokyo (JP)

(72) Inventors: Hisashi Mogi, Tokyo (JP); Fumiaki Takahashi, Tokyo (JP); Hideyuki Hamamura, Tokyo (JP); Satoshi Arai, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 386 days.

(21) Appl. No.: 16/772,544

(22) PCT Filed: Jan. 31, 2019

(86) PCT No.: PCT/JP2019/003385
§ 371 (c)(1),
(2) Date: Jun. 12, 2020

(87) PCT Pub. No.: WO2019/151397
PCT Pub. Date: Aug. 8, 2019

(65) Prior Publication Data

US 2021/0082606 A1 Mar. 18, 2021

(30) Foreign Application Priority Data

Jan. 31, 2018 (JP) ..... JP2018-014874

(51) Int. Cl.
*H01F 1/147* (2006.01)
*C21D 8/12* (2006.01)

(52) U.S. Cl.
CPC ..... *H01F 1/147* (2013.01); *C21D 8/12* (2013.01)

(58) Field of Classification Search
CPC ..... C21D 9/46
See application file for complete search history.

(56) References Cited

U.S. PATENT DOCUMENTS

| | | | |
|---|---|---|---|
| 2012/0131982 | A1 | 5/2012 | Imamura et al. |
| 2013/0139932 | A1 | 6/2013 | Sakai et al. |
| 2016/0177413 | A1 | 6/2016 | Kwon et al. |

FOREIGN PATENT DOCUMENTS

| | | | |
|---|---|---|---|
| JP | 5-247538 | A | 9/1993 |
| JP | 6-65644 | A | 3/1994 |
| JP | 7-220913 | A | 8/1995 |
| JP | 2001-316896 | A | 11/2001 |

(Continued)

OTHER PUBLICATIONS

"Methods of measurement of the magnetic properties of magnetic steel sheet and strip by means of a single sheet tester", JIS C 2556, 2015, total 170 pages.

(Continued)

*Primary Examiner* — Jophy S. Koshy
(74) *Attorney, Agent, or Firm* — Birch, Stewart, Kolasch & Birch, LLP

(57) ABSTRACT

A grain-oriented electrical steel sheet according to the present invention has a steel sheet surface provided with grooves and includes two or more broken lines including the grooves having a length of 5 to 10 mm on a straight line intersecting a rolling direction on the steel sheet surface. In each of the broken lines including the grooves, the grooves are arranged at equal intervals, and a ratio of the length of the groove to a length of a non-groove is in a range of 1:1 to 1.5:1.

4 Claims, 6 Drawing Sheets

(GROOVE PATTERN OF PRESENT ELECTROMAGNETIC STEEL SHEET)

(CONVENTIONAL COMMON GROOVE PATTERN)

(56) References Cited

FOREIGN PATENT DOCUMENTS

| | | | |
|---|---|---|---|
| JP | 2016-532776 | A | 10/2016 |
| WO | WO 2012/033197 | A1 | 3/2012 |
| WO | WO 2012/164702 | A1 | 12/2012 |

OTHER PUBLICATIONS

"Test methods for electrical steel strip and sheet", JIS C 2550, 2011, total 477 pages.
International Search Report for PCT/JP2019/003385 dated Apr. 2, 2019.
Written Opinion of the International Searching Authority for PCT/JP2019/003385 (PCT/ISA/237) dated Apr. 2, 2019.

(CONVENTIONAL COMMON GROOVE PATTERN)

(GROOVE PATTERN OF PRESENT ELECTROMAGNETIC STEEL SHEET)

GRAIN-ORIENTED ELECTRICAL STEEL SHEET

TECHNICAL FIELD OF THE INVENTION

The present invention relates to a grain-oriented electrical steel sheet.

Priority is claimed on Japanese Patent Application No. 2018-14874, filed on Jan. 31, 2018, the content of which is incorporated herein by reference.

RELATED ART

Iron cores are widely used as magnetic cores for transformers, reactors, noise filters, and the like. The grain-oriented electrical steel sheet which is increased in magnetic flux density by increasing the integration degree of the so-called Goss orientation is used as a material for such the iron core. In the steel sheet with a high integration degree, crystal grains become large, and as a result, magnetic domains become wide. In the grain-oriented electrical steel sheet having wide magnetic domains, the iron loss increases. Therefore, in view of improving efficiency, a reduction in the iron loss is one of the important issues.

As a method for reducing iron loss in the grain-oriented electrical steel sheet, magnetic domain refinement (magnetic domain control) has been put to practical use. As a magnetic domain control method, the non-destructive magnetic domain control for forming fine strains on the steel sheet surface, and the destructive magnetic domain control for forming fine grooves on the steel sheet surface are known.

The iron core is roughly classified into a stacked iron core and a wound iron core. The wound iron core manufactured by bending the grain-oriented electrical steel sheet is usually manufactured through an annealing process to relief stresses generated during bending. Therefore, the grain-oriented electrical steel sheet used for the wound iron core is required to have heat resistance. The fine strains introduced into the steel sheet surface by the non-destructive magnetic domain control disappear during the annealing process. That is, the steel sheet with the fine strains have no heat resistance. In contrast, the fine grooves formed on the steel sheet surface by the destructive magnetic domain control do not disappear during the annealing process. Therefore, the steel sheet with the fine grooves is generally used as a material for the wound iron core.

For example, Patent Document 1 discloses a method of manufacturing a grain-oriented electrical steel sheet having a steel sheet surface provided with fine grooves and having low iron loss. In this method, the grooves that do not disappear in a final treatment process are formed on a cold-rolled steel sheet obtained after final cold-rolling process so as to extend in a direction intersecting the rolling direction of the cold-rolled steel sheet.

Patent Document 2 discloses a grain-oriented electrical steel sheet having a front surface provided with continuous pattern traces of craters and having a flat back surface. The continuous pattern traces are uniformly arranged so that the craters have an average diameter of 100 to 200 μm, a depth of 10 to 30 μm, and a length of 3 to 10 mm in a rolling direction, and so that a hole processing ratio of the craters in the width direction of the steel sheet becomes 1.0 or less.

Patent Document 3 discloses a method of manufacturing a low iron loss grain-oriented electrical steel sheet. In this method, after the final annealing, a portion of the insulation coating provided on one surface or both surfaces of the grain-oriented electrical steel sheet is removed linearly or in the form of a dot row to expose the base metal, and thereafter grooves having a depth of 5 to 40 μm are formed on the exposed portion of the base metal of at least one surface of the steel sheet by electrolytic etching using a neutral salt solution.

PRIOR ART DOCUMENT

Patent Document

[Patent Document 1] Japanese Unexamined Patent Application, First Publication No. H5-247538

[Patent Document 2] Japanese Unexamined Patent Application, First Publication No. H7-220913

[Patent Document 3] Japanese Unexamined Patent Application, First Publication No. 2001-316896

DISCLOSURE OF THE INVENTION

Problems to be Solved by the Invention

In the electrical steel sheets described in the prior art document, although the effect of improving iron loss is maintained even after the annealing process for reliefing stresses, when continuous and linear grooves perpendicular to the rolling direction are formed on the steel sheet surface in order to obtain a high iron loss reducing effect, there is a problem that the steel sheet is fractured along the grooves by bending during the manufacturing of a wound iron core. Therefore, usually, continuous and linear grooves are formed at a predetermined angle with respect to the direction perpendicular to the rolling direction in order to suppress the fracture of the steel sheet due to bending.

However, when the angle with respect to the direction perpendicular to the rolling direction is increased, the magnetic domain control effect is reduced, so that there is a trade-off relationship that the iron loss is deteriorated. Therefore, it is difficult to obtain a grain-oriented electrical steel sheet having repeated bendability and low iron loss at a high level.

The present invention has been made in view of the above circumstances, and an object thereof is to provide a heat-resistant grain-oriented electrical steel sheet having both low iron loss and excellent repeated bendability at a high level.

Means for Solving the Problem

The present invention adopts the following means in order to solve the above problems and achieve the object.

(1) A grain-oriented electrical steel sheet according to an aspect of the present invention has a steel sheet surface provided with grooves and includes two or more broken lines including the grooves having a length of 5 to 10 mm on a straight line intersecting a rolling direction on the steel sheet surface. In each of the broken lines including the grooves, the grooves are arranged at equal intervals, and a ratio of the length of the groove to a length of a non-groove is in a range of 1:1 to 1.5:1.

(2) In the grain-oriented electrical steel sheet described in above (1), the adjacent broken lines including the grooves may be parallel and have an interval in a range of 2.0 to 20 mm, and a relationship between a length A of the groove, a length B of the non-groove, and a length C of an overlap between the grooves in a direction perpendicular to the broken lines including the grooves may satisfy Formula (1).

$$C=(A-B)/2 \quad \text{Formula (1)}$$

(3) In the grain-oriented electrical steel sheet described in above (1) or (2), the broken lines including the grooves may have an angle in a range of 75° to 105° with respect to the rolling direction.

Effects of the Invention

According to the present invention, it is possible to provide a heat-resistant grain-oriented electrical steel sheet having both low iron loss and excellent repeated bendability at a high level.

EMBODIMENTS OF THE INVENTION

Hereinafter, a grain-oriented electrical steel sheet according to the present embodiment will be described in detail.

In addition, terms that specify shapes, geometric conditions, and the degree thereof, for example, "parallel", "vertical", "same", and "perpendicular", and values of lengths and angles and the like, which are used in the present specification, are not limited to strict meaning, and are interpreted to include a range in which a similar function can be expected.

The grain-oriented electrical steel sheet according to the present embodiment (hereinafter, simply referred to as the present electrical steel sheet) has a steel sheet surface provided with grooves and includes two or more broken lines including the grooves having a length of 5 to 10 mm on a straight line intersecting a rolling direction on the steel sheet surface. In each of the broken lines including the grooves, the grooves are arranged at equal intervals, and a ratio of the length of the groove to a length of a non-groove is in a range of 1:1 to 1.5:1.

Figure 2:
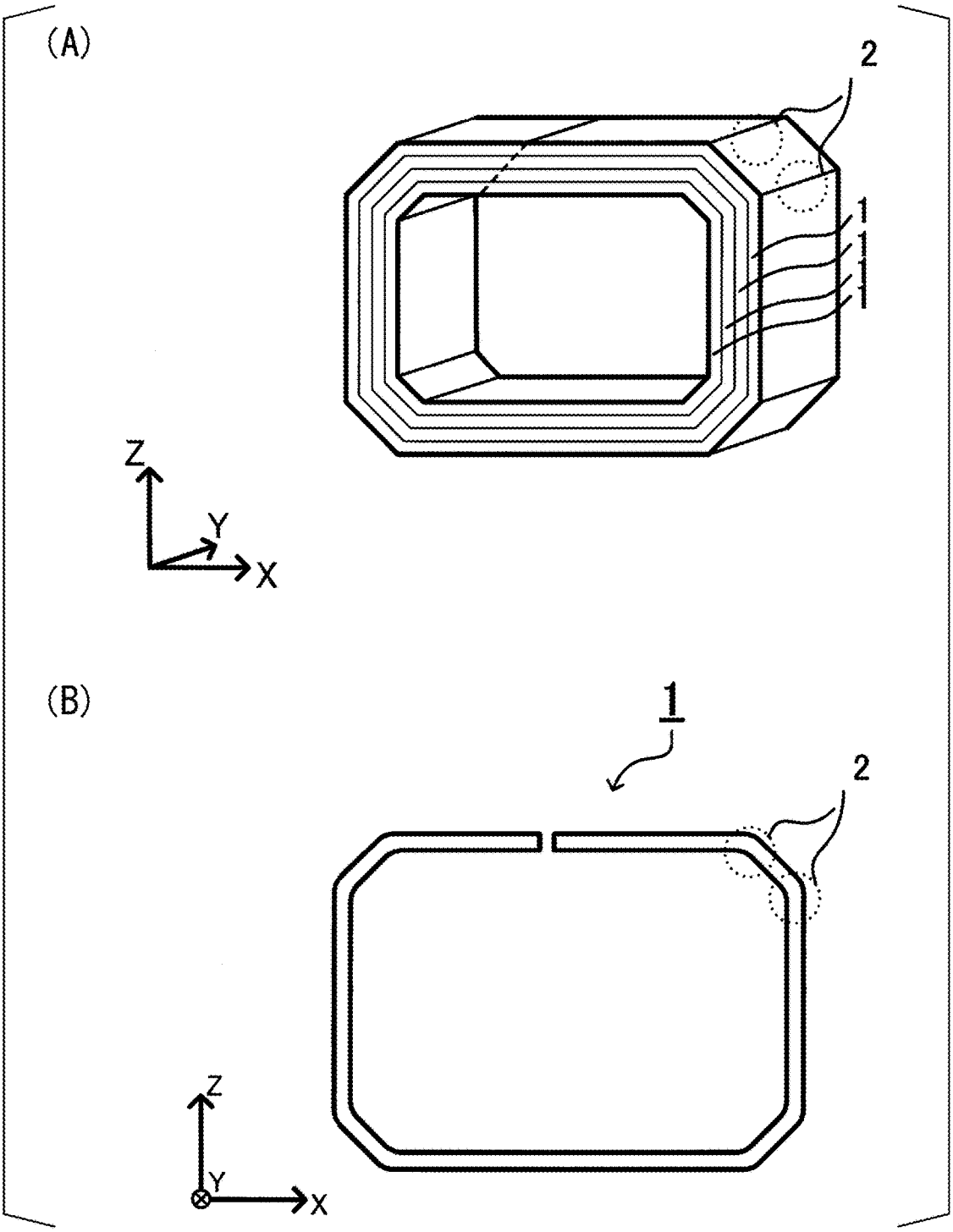
FIG. 2 is a schematic view showing an example of a wound iron core.

As described above, for the purpose of reducing iron loss while maintaining heat resistance, a technique of forming grooves on the surface of a base steel sheet to refine magnetic domains and improve iron loss has been known. However, although electrical steel sheets subjected to magnetic domain control by forming continuous and linear grooves perpendicularly to the rolling direction of the base steel sheet can achieve a high iron loss improvement effect, there is a problem that the steel sheet is fractured by bending during the manufacturing of a wound iron core. (A) in FIG. 2 shows a schematic view of a wound iron core, and (B) in FIG. 2 shows a schematic view of a grain-oriented electrical steel sheet constituting one layer of the wound iron core. As shown in FIG. 2, the wound iron core is usually manufactured by laminating grain-oriented electrical steel sheets that have been bent perpendicularly to the rolling direction. This is because, in an electrical steel sheet in the related art in which magnetic domain control is performed by forming continuous (solid line-shaped) grooves continuously in a perpendicular direction, stresses concentrate on the grooves, and the steel sheet is easily fractured.

For this reason, in the related art, even allowing for weakening of the magnetic domain control effect, continuous and linear grooves are formed at a predetermined angle with respect to the direction perpendicular to the rolling direction to suppress fracture of the steel sheet due to bending.

The present inventors have found that a grain-oriented electrical steel sheet having both low iron loss and high repeated bendability can be obtained by forming grooves for magnetic domain control in a discontinuous broken line shape in a specific pattern on the surface of the grain-oriented electrical steel sheet. More specifically, the present inventors have found that in a case where the groove formation pattern on the steel sheet surface satisfies at least the following two conditions, it is possible to achieve both a reduction in iron loss and an improvement in repeated bendability.

(Condition 1) There are two or more broken lines including grooves having a length of 5 to 10 mm on a straight line intersecting a rolling direction on the steel sheet surface.

(Condition 2) In each of the broken lines including the groove, the grooves are arranged at equal intervals, and the ratio of the length of the groove to the length of a non-groove is in a range of 1:1 to 1.5:1.

As described above, by forming the grooves having a specific length in the broken line shape, it becomes possible to realize an iron loss equivalent to that of a grain-oriented electrical steel sheet having continuous and linear grooves that have been used in the related art, while suppressing fracture of the steel sheet caused by the concentration of stresses on the groove portion due to bending.

Hereinafter, the present electrical steel sheet will be described in detail.

1. Basic Configuration of Present Electrical Steel Sheet

The present electrical steel sheet is not particularly limited as long as the electrical steel sheet is a steel sheet having a 180° domain wall parallel to a rolling direction, but is preferably a steel sheet in which the orientations of crystal grains in the steel sheet are highly integrated in the {110}<001> orientation and excellent magnetic characteristics are provided in the rolling direction. The present electrical steel sheet can be appropriately selected from known grain-oriented electrical steel sheets according to the required performance. Hereinafter, an example of a preferable base steel sheet will be described, but the base steel sheet is not limited to the following example.

The chemical composition of the base steel sheet is not particularly limited, but preferably contains, for example, by mass %, Si: 0.8% to 7%, C: more than 0% and 0.085% or less, acid-soluble Al: 0% to 0.065%, N: 0% to 0.012%, Mn: 0% to 1%, Cr: 0% to 0.3%, Cu: 0% to 0.4%, P: 0% to 0.5%, Sn: 0% to 0.3%, Sb: 0% to 0.3%, Ni: 0% to 1%, S: 0% to 0.015%, Se: 0% to 0.015%, and a remainder consisting of Fe and impurities. The chemical composition of the base steel sheet is a preferable chemical composition for controlling the base steel sheet to the Goss texture in which the crystal orientations are integrated in a 11101<001> orientation. Among the elements in the base steel sheet, Si and C are base elements, and acid-soluble Al, N, Mn, Cr, Cu, P, Sn, Sb, Ni, S, and Se are optional elements. Since these optional elements may be contained according to the purpose, there is no need to limit the lower limit, and the lower limit may be 0%. In addition, even if these optional elements are contained as impurities, the effects of the present invention are not impaired. In the base steel sheet, the remainder of the base elements and the optional elements consists of Fe and impurities.

The "impurities" mean elements that are unavoidably incorporated from ore, scrap, a manufacturing environment, or the like as a raw material when a base steel sheet is industrially manufactured.

In general, an electrical steel sheet undergoes purification annealing during secondary recrystallization. In the purification annealing, inhibitor-forming elements are discharged to the outside of the system. In particular, the concentrations of N and S are significantly reduced, and become 50 ppm or less. The concentration reaches 9 ppm or less, and furthermore, 6 ppm or less under ordinary purification annealing conditions, and reaches a degree (1 ppm or less) that cannot be detected by general analysis when purification annealing is sufficiently performed.

The chemical composition of the base steel sheet may be measured by a general steel analysis method. For example, the chemical composition of the base steel sheet may be measured using inductively coupled plasma-atomic emission spectrometry (ICP-AES). Specifically, for example, the chemical composition can be specified by acquiring a 35 mm square test piece from the center position of the base steel sheet after the coating is removed, and performing a measurement under conditions based on a calibration curve prepared in advance by using ICPS-8100 (a measuring device) manufactured by Shimadzu Corporation, or the like. C and S may be measured using a combustion-infrared absorption method, and N may be measured using an inert gas fusion-thermal conductivity method.

A method of manufacturing the base steel sheet is not particularly limited, and a method of a grain-oriented electrical steel sheet known in the related art can be appropriately selected. As a preferred specific example of the manufacturing method, for example, a method in which a slab is heated to 1000° C. or higher, subjected to hot rolling, thereafter subjected to hot-band annealing as necessary, and then subjected to one cold rolling or two or more cold rollings with process annealing therebetween to obtain a cold-rolled steel sheet, and the cold-rolled steel sheet is subjected to decarburization annealing by being heated to 700° C. to 900° C. in, for example, a wet hydrogen-inert gas atmosphere, further subjected to nitriding annealing as necessary, and subjected to final annealing at about 1000° C. can be adopted.

The thickness of the base steel sheet is not particularly limited, but is preferably 0.1 mm or more and 0.5 mm or less, and more preferably 0.15 mm or more and 0.40 mm or less.

A coating may be formed on the surface of the present electrical steel sheet (the surface of the base steel sheet). Examples of such a coating include a glass film formed on the base steel sheet. Examples of the glass film include a coating having one or more oxides selected from forsterite ($Mg_2SiO_4$), spinel ($MgAl_2O_4$), and cordierite ($Mg_2Al_4Si_5O_{16}$).

The thickness of the coating is not particularly limited, but is preferably 0.5 μm or more and 3 μm or less.

2. Magnetic Domain Control (Groove Pattern of Present Electrical Steel Sheet)

Figure 1A:
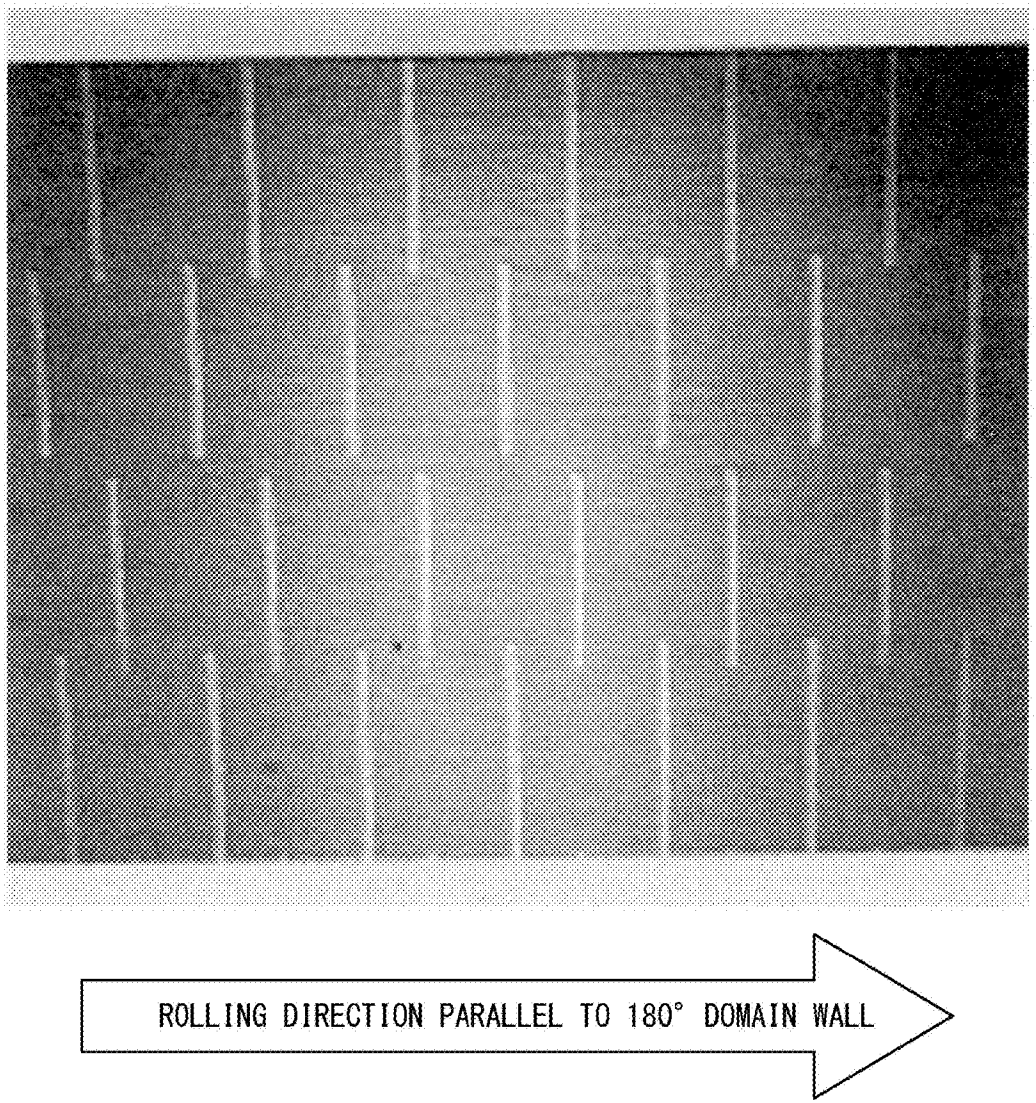
FIG. 1A is a schematic view showing an example of a grain-oriented electrical steel sheet subjected to magnetic domain control according to the present invention.

In the present embodiment, magnetic domain control is performed by forming broken line-shaped grooves in a specific pattern on the steel sheet surface of the present electrical steel sheet (the surface of the base steel sheet). FIG. 1A shows an example of the present electrical steel sheet subjected to magnetic domain control by forming grooves in a broken line shape.

As shown in FIG. 1A, the present electrical steel sheet includes two or more broken lines including grooves having a length of 5 to 10 mm on a straight line intersecting the rolling direction on the steel sheet surface.

When the length of each groove exceeds 10 mm, stresses tend to concentrate on the grooves, and the steel sheet is easily fractured. On the other hand, when the length of each groove is less than 5 mm, due to the problem of processing accuracy, as will be described later, it is difficult to process the grooves such that the overlap (the length of overlap) between the grooves in the direction perpendicular to the broken lines including the grooves is minimized, and there are cases where the effect of reducing iron loss cannot be sufficiently obtained. Therefore, the length of each groove is 5 to 10 mm, and preferably 7 to 8 mm.

The width of each groove is not particularly limited, but is usually in a range of 10 to 500 μm, and may be in a range of 20 to 400 μm in order to efficiently perform the magnetic domain control.

The depth of each groove is not particularly limited, but is usually in a range of 2 to 50 μm, and may be in a range of 4 to 40 μm in order to efficiently perform the magnetic domain control.

There is no particular limitation as long as there are two or more broken lines including the grooves, but it is preferable that the broken lines in a specific pattern described below are provided on the entire steel sheet.

In each of the broken lines including the grooves, the grooves are arranged at equal intervals, and the ratio of the length of the groove to the length of the non-groove is 1:1 to 1.5:1. When the length of the non-groove exceeds one time the length of the groove, the effect of improving iron loss is not sufficient, and when the length of the groove exceeds 1.5 times the length of the non-groove, sufficiently high repeated bendability cannot be obtained. The ratio of the length of the groove to the length of the non-groove is preferably 1:1. The "non-groove" indicates a region between adjacent grooves on one broken line, that is, a region where no groove is present.

Figure 1B:
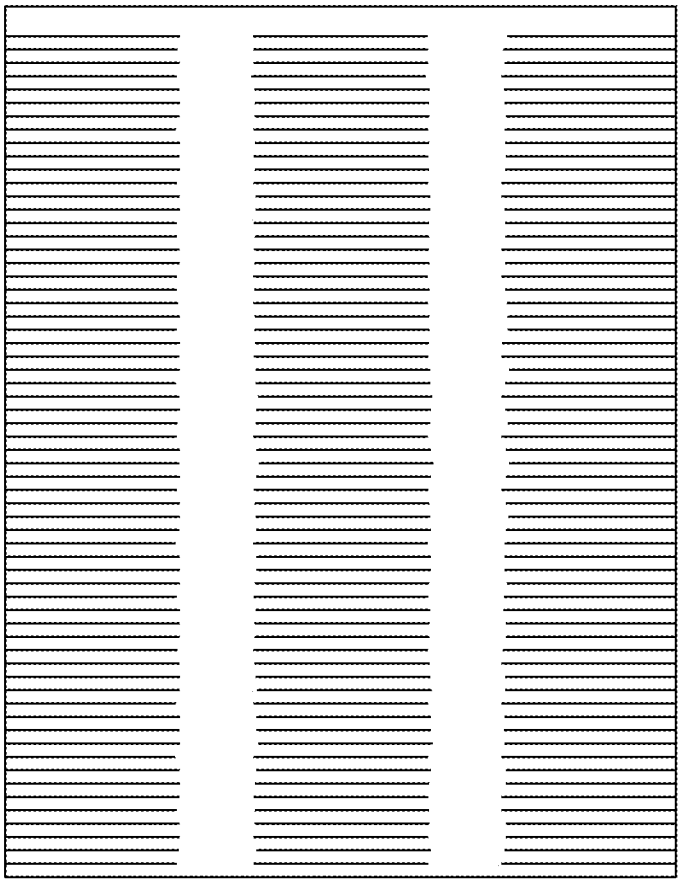
FIG. 1B is a schematic view comparing a groove pattern of the present electrical steel sheet to a conventional common groove pattern of a general electrical steel sheet on the same scale.
Figure 1B:
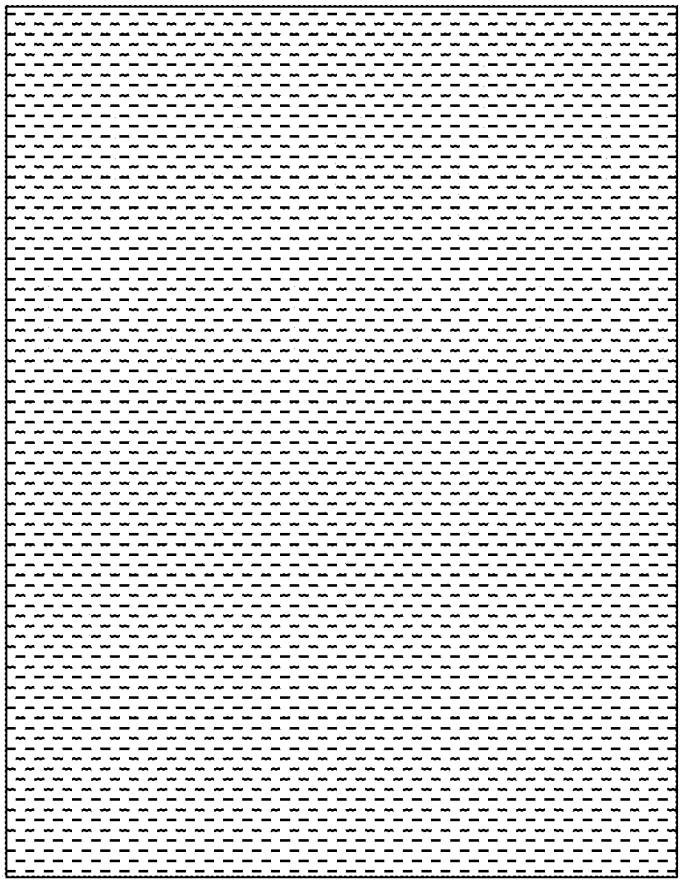

As described above, the length of each groove in the present electrical steel sheet is 5 mm to 10 mm, but this length is much shorter than the length of a general groove in the related art. The length of a general groove in the related art is on the order of several hundred mm, such as about 200 mm. FIG. 1B is a schematic view comparing the groove pattern of the present electrical steel sheet to the conventional common groove pattern of the general electrical steel sheet on the same scale. As shown in FIG. 1B, in a case where the groove pattern of the present electrical steel sheet is compared to the conventional common groove pattern of the general electrical steel sheet on the same scale, it can be easily understood that both patterns are clearly different.

As described above, the length of the groove in the related art is set to obtain the iron loss reducing effect, and is not set for the purpose of improving the repeated bendability, so that the length of the groove is a relatively large numerical value on the order of several hundred mm. On the other hand, the present inventors have conducted intensive studies not only to obtain the iron loss reduction effect but also to improve the repeated bendability, and as a result, found that in a case where at least the following two conditions are satisfied, both the iron loss reduction and the improvement in repeated bendability can be obtained.

(Condition 1) There are two or more broken lines including grooves having a length of 5 to 10 mm on a straight line intersecting a rolling direction on the steel sheet surface.

(Condition 2) In each of the broken lines including the groove, the grooves are arranged at equal intervals, and the ratio of the length of the groove to the length of a non-groove is in a range of 1:1 to 1.5:1.

Therefore, forming grooves having a length as extremely short as 5 to 10 mm as in the present electrical steel sheet based on the groove forming technique in the related art, which has no interest in the improvement of repeated bendability, is not easily conceivable by those skilled in the art.

In the present electrical steel sheet, it is preferable that the adjacent broken lines including the grooves are parallel and have an interval in a range of 2.0 to 20 mm, and a relationship between a length A of the groove, a length B of the non-groove, and a length C of an overlap between the grooves in a direction perpendicular to the broken lines including the grooves satisfies Formula (1).

$$C=(A-B)/2 \quad \text{Formula (1)}$$

In a case where the adjacent broken lines are not parallel, and in a case where the interval between the adjacent broken lines is out of the above range, the effect of improving iron loss is not sufficient. In order to obtain an excellent iron loss improvement effect, the interval between the adjacent broken lines is preferably in a range of 2 to 20 mm, and more preferably in a range of 5 to 10 mm.

In addition, it is preferable that in the adjacent broken lines, the length C of the overlap between the grooves in the direction perpendicular to the broken lines is minimum. In a case where the relationship between the length A of the groove, the length B of the non-groove, and the length C of the overlap between the grooves in the direction perpendicular to the broken lines including the grooves satisfies Formula (1), the length C of the overlap between the grooves is minimized. Even in a case where the length C of the overlap between the grooves of the adjacent broken lines is not minimum (in a case where the relationship between A, B, and C does not satisfy Formula (1)), there is no effect on the repeated bendability, but the iron loss cannot be sufficiently reduced.

Hereinafter, referring to FIGS. 3 and 4, a groove pattern in which the length C of the overlap between grooves is minimum will be described separately in a case where the length B of the non-groove is the same as the length A of the groove and a case where the length B of the non-groove is shorter than the length A of the groove.

(1) In Case where Length B of Non-Groove is Same as Length A of Groove

Figure 3:
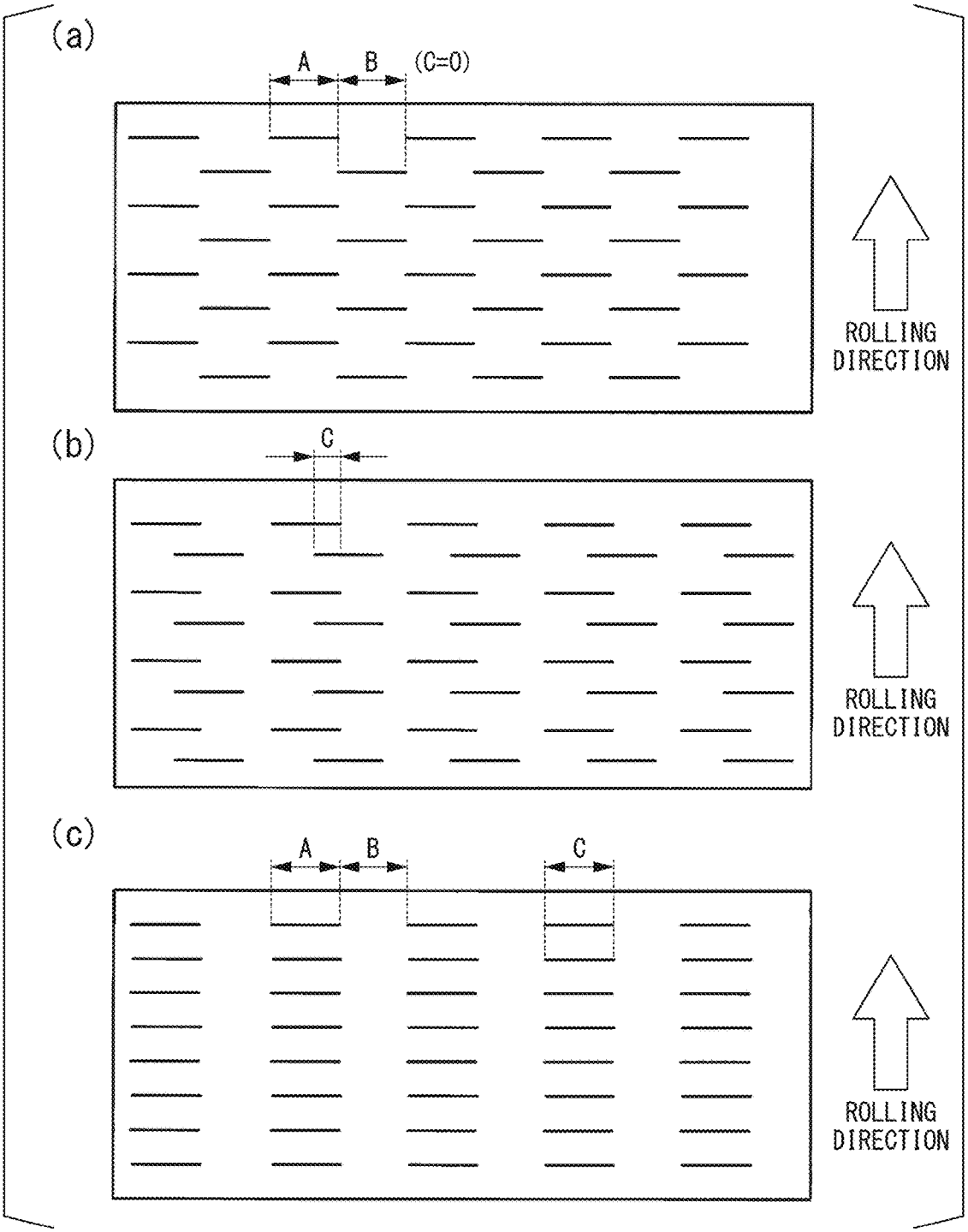
FIG. 3 is a schematic view of an electrical steel sheet which is subjected to magnetic domain control by forming broken lines in which the length of a non-groove is the same as the length of a groove, perpendicularly to a rolling direction.

FIG. 3 shows a schematic view of an electrical steel sheet which is subjected to magnetic domain control by forming broken lines in which the length B of the non-groove is the same as the length A of the groove, perpendicularly to the rolling direction.

In the broken lines including the grooves shown in (b) and (c) in FIG. 3, the length C of the overlap between the grooves of the broken lines adjacent in the perpendicular direction is not the minimum, and the grooves overlap entirely or partially. As described above, in a portion where the grooves overlap each other, the interval between the grooves is too small, and the iron loss is deteriorated. In addition, since the area of a portion having no groove, that is, a portion that is not subjected to magnetic domain control is increased, the iron loss is deteriorated.

Therefore, even if the ratio of the length A of the groove to the length B of the non-groove is 1:1, the iron loss cannot be sufficiently reduced.

In the broken lines including the grooves shown in (a) in FIG. 3, the length C of the overlap between the grooves of the broken lines adjacent in the perpendicular direction is the minimum (C=0), and the grooves do not overlap. In this case, the interval between the grooves is kept under the optimum condition, and the area of the portion that is not subjected to magnetic domain control and has no groove is minimized, so that the effect of reducing iron loss is high. Therefore, it is possible to sufficiently reduce the iron loss.

(2) In Case where Length a of Groove is Longer than Length B of Non-Groove

Figure 4:
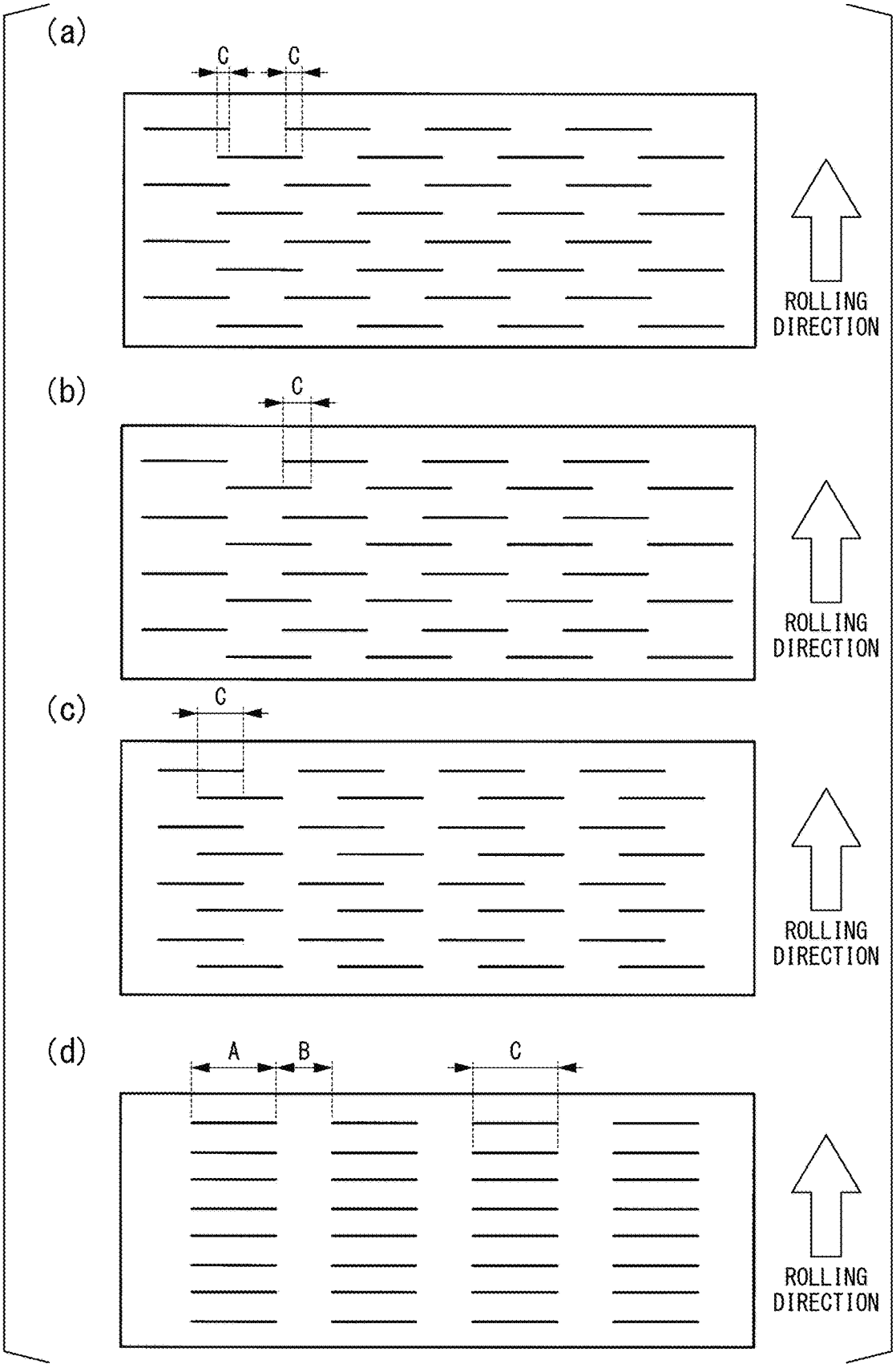
FIG. 4 is a schematic view of an electrical steel sheet which is subjected to magnetic domain control by forming broken lines in which the length of a groove is longer than the length of a non-groove, perpendicularly to the rolling direction.

FIG. 4 shows a schematic view of an electrical steel sheet which is subjected to magnetic domain control by forming broken lines in which the length B of a non-groove is shorter than the length A of a groove, perpendicularly to the rolling direction. In FIG. 4, the ratio of the length A of the groove to the length B of the non-groove is 1.5:1.

In the broken lines including the grooves shown in (b), (c), and (d) in FIG. 4, the length C of the overlap between the grooves of the broken lines adjacent in the perpendicular direction is not the minimum, and the grooves overlap entirely or partially. As described above, in a portion where the grooves overlap each other, the interval between the grooves is too small, and the iron loss is deteriorated. In addition, since the area of a portion that is not subjected to magnetic domain control and has no groove is increased, the iron loss is deteriorated. Therefore, even if the ratio of the length of the groove to the length of the non-groove is 1.5:1, the iron loss cannot be sufficiently reduced.

In the broken lines including the grooves shown in (a) in FIG. 4, the grooves partially overlap, but the length C of the overlap between the grooves of the broken lines adjacent in the perpendicular direction is minimum. In this case, the interval between the grooves is kept under the optimum condition, and there is no portion that is not subjected to magnetic domain control and has no groove. Therefore, the effect of reducing iron loss is high. Therefore, it is possible to sufficiently reduce the iron loss.

Figure 5:
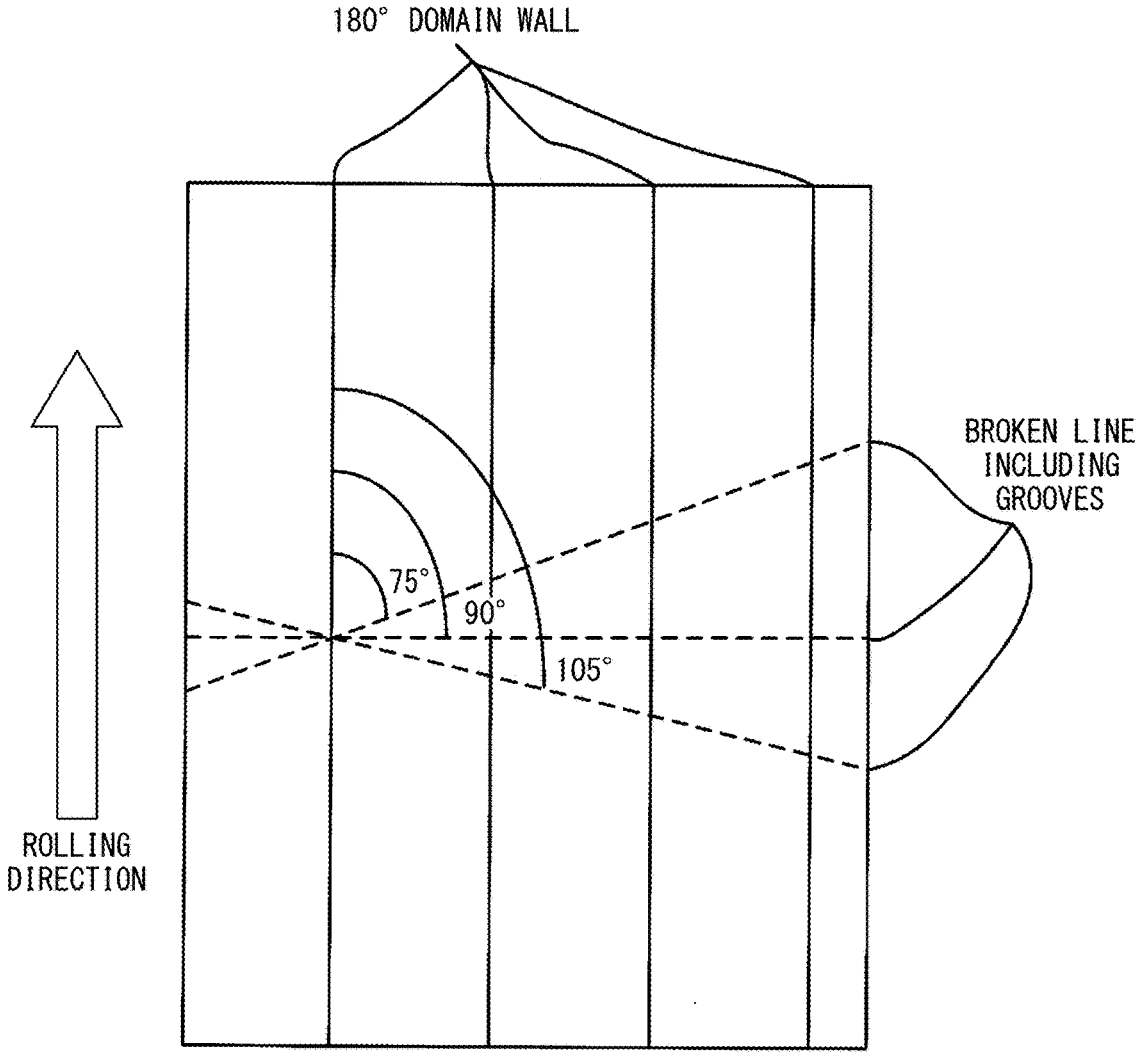
FIG. 5 is a schematic view showing an angle of the broken line including the grooves with respect to the rolling direction.

In the present electrical steel sheet, it is preferable that the broken lines including the grooves have an angle in a range of 75° to 105° with respect to the rolling direction. FIG. 5 schematically shows the angles of the broken lines including the grooves with respect to the rolling direction. As the angle of the broken lines including the grooves with respect to the rolling direction deviates from 90°, stresses are less likely to be concentrated on the grooves, so that excellent repeated bendability is achieved. However, the magnetic domain control effect is weakened, and the iron loss increases.

In the present electrical steel sheet, by appropriately selecting the angle of the broken lines including the grooves with respect to the rolling direction within a range of 75° to 105°, the performance required for a wound iron core can be achieved at a higher level compared to an electrical steel sheet in the related art having grooves continuously and linearly present in the width direction on the steel sheet surface.

In addition, since the differences of 75° and 105° from the case where the angle with respect to the rolling direction is 90° are the same as 15°, the characteristics as the steel sheet are the same.

A method of forming grooves in the present electrical steel sheet is not particularly limited, but for example, techniques such as etching, gear pressing, and laser irradiation can be used.

In particular, it is preferable to use a special polygon mirror that reflects laser light to irradiate a steel sheet because grooves can be efficiently formed. A polygon mirror is usually in the form of a hexagonal to octagonal prism. In the special polygon mirror, several to several tens of comb-shaped grooves are formed on the rectangular side faces forming the prism, and the bottom surface of the groove has an inclination of several degrees.

In a case of forming grooves in the steel sheet during the manufacturing process of the present electrical steel sheet, there is no particular limitation on the step in which the grooves are formed. For example, the grooves may be formed on the cold-rolled steel sheet, the final-annealed steel sheet, or the steel sheet after the coating is formed. The grooves may also be formed on the cold-rolled steel sheet so as not to cause a fracture in an insulation coating.

3. Applications of Heat-Resistant Grain-Oriented Electrical Steel Sheets

The present electrical steel sheet has heat resistance, excellent iron loss and repeated bendability, and is therefore particularly suitable as a material for a wound iron core.

EXAMPLES

Hereinafter, the technical contents of the present invention will be further described with reference to examples of the present invention. The conditions in the following examples are examples of conditions adopted to confirm the feasibility and effects of the present invention, and the present invention is not limited to these examples of conditions. The present invention can adopt various conditions as long as the object of the present invention is achieved without departing from the gist of the present invention.

The base steel sheet used in the present examples is a steel sheet having a width of 1050 mm and a thickness of 0.23 mm manufactured as described below, and contains, as a chemical composition, Fe and 3.01% of Si. The width and depth of the groove formed by performing the laser processing after the cold rolling process are common to all steel sheets.

1. Manufacturing of Grain-Oriented Electrical Steel Sheet

Example 1

(1) Base Steel Sheet

Molten steel containing, as a chemical composition, 3.01% Si and 0.058% Mn as primary elements in terms of mass fraction and the remainder consisting of Fe and impurities is supplied to a continuous casting machine to continuously produce slabs. Subsequently, the obtained slab was heated, and thereafter hot rolling was performed on the slab to obtain a hot-rolled steel sheet having a thickness of 1.6 mm.

The obtained hot-rolled steel sheet was annealed under the condition of heating at 900° C. for 30 seconds, and then cold-rolled with the surface in a pickled state to obtain a cold-rolled steel sheet having a thickness of 0.23 mm.

Grooves were formed in the obtained cold-rolled steel sheet under the conditions described below.

After the formation of the grooves, the steel sheet was subjected to decarburization annealing by being heated in a wet hydrogen-inert gas atmosphere under a condition of 800° C. and further subjected to nitriding annealing.

An annealing separating agent containing magnesia (MgO) as a primary component was applied to the surface of the steel sheet on which the grooves were formed (the surface of the oxide layer), and the steel sheet having the annealing separating agent applied thereto was subjected to a heat treatment by being heated under a temperature condition of 1100° C. for 20 hours to obtain a final-annealed steel sheet.

An insulation coating solution containing colloidal silica and a phosphate was applied to the obtained final-annealed steel sheet, and a heat treatment was performed thereon at 840° C., whereby a grain-oriented electrical steel sheet of Example 1 having a sheet width of 1050 mm, a sheet thickness of 0.23 mm, and grooves formed as shown in Table 2 was finally obtained.

(2) Magnetic Domain Control (Formation of Grooves)

For the formation of broken line-shaped grooves on the cold-rolled steel sheet, a special polygon mirror obtained by processing a general polygon mirror that reflects laser light to irradiate a steel sheet was used. A polygon mirror is usually in the form of a hexagonal to octagonal prism. In the special polygon mirror used, several to several tens of comb-shaped grooves are formed on the rectangular side faces forming the prism, and the bottom surface of the groove has an inclination of several degrees. Using such a special polygon mirror, broken line-shaped grooves (groove length 10 mm, non-groove length 10 mm, depth 20 μm, and width 100 μm) were formed on the surface of the cold-rolled steel sheet at an angle of 90° with respect to the rolling direction at intervals of 2 mm.

Examples 2 to 17

Grain-oriented electrical steel sheets of Examples 2 to 17 were obtained in the same manner as in Example 1, except that grooves were formed under the conditions shown in Tables 2 to 6.

Comparative Example 1

The base steel sheet used in Example 1 was used as a grain-oriented electrical steel sheet of Comparative Example 1 without forming grooves.

Comparative Examples 2 to 24

Grain-oriented electrical steel sheets of Comparative Examples 2 to 24 were obtained in the same manner as in Example 1 except that grooves were formed under the conditions shown in Tables 1 to 6.

2. Evaluation of Iron Loss

A measurement by an electrical steel sheet single sheet magnetic characteristic test using an H coil method described in JIS C 2556 was performed on samples of the grain-oriented electrical steel sheets of the examples and comparative examples (width 30 mm×length 300 mm, 0.5 kg per set) under the conditions of a frequency of 50 Hz and a magnetic flux density of 1.7 T, and the iron loss values W17/50 (W/Kg) of the grain-oriented electrical steel sheets of the examples and comparative examples were obtained.

From the obtained iron loss value, iron loss improvement amounts obtained using Calculation Formula (2) were calculated.

Iron loss improvement amount (%)=(base steel sheet iron loss value−test steel sheet iron loss value)×100/base steel sheet iron loss value Formula (2)

3. Evaluation of Repeated Bendability

As a method of evaluating repeated bendability, a measurement was performed by the method shown in the item of the mechanical test described in JIS C 2550. The sample, which was a 30×300 mm rectangle, was sandwiched in a round metal tester having a radius of 5 mm at room temperature (20±15° C.), and the test piece was bent to one side at 90° along the entire length, then returned to the original position (this is called one bend), then similarly bent to the other side at 90°, and returned to the original position (this is called two bends). The number of times was counted, and when a crack had passed through to the rear surface of the test piece, this was not counted as the number of bends, but the process is ended.

From the obtained minimum number of fractures, a minimum number of fractures ratio obtained using Calculation Formula (3) was calculated. In this test, a minimum number of fractures ratio of 8.1% or more is an index of whether or not the material can be used as the material for a wound core.

Minimum number of fractures ratio (%)=minimum number of fractures of test steel sheet×100/minimum number of fractures of base steel sheet Formula (3)

In addition, from the obtained average number of fractures, an average number of fractures ratio obtained using Calculation Formula (4) was calculated.

Average number of fractures ratio (%)=average number of fractures of test steel sheet×100/average number of fractures of base steel sheet Formula (4)

4. Evaluation Results

The results are summarized in Tables 1 to 6.

TABLE 1

| | Magnetic domain control | Length of groove (mm) | Length of non-groove (mm) | Ratio of length of groove to length of non-groove | Interval between solid lines or broken lines (mm) | Angle (°) | Overlap | Iron loss W17/50 (W/Kg) | Iron loss improvement amount (%) | Repeated bending test: Average number of fractures | Repeated bending test: Average number of fractures ratio (%) | Repeated bending test: Minimum number of fractures | Repeated bending test: Minimum number of fractures ratio (%) |
|---|---|---|---|---|---|---|---|---|---|---|---|---|---|
| Comparative Example 1 | Absent | — | — | — | — | 90 | — | 0.850 | 0.00 | 40.0 | 100.0 | 37 | 100.0 |
| Comparative Example 2 | Present (solid line) | — | — | — | 5 | 90 | Present | 0.730 | 14.12 | 1.5 | 3.8 | 1 | 2.7 |
| Comparative Example 3 | Present (solid line) | — | — | — | 2.5 | 90 | Present | 0.790 | 7.06 | 2.0 | 5.0 | 1 | 2.7 |
| Comparative Example 4 | Present (solid line) | — | — | — | 5 | 95 | Present | 0.736 | 13.41 | 1.5 | 3.8 | 1 | 2.7 |
| Comparative Example 5 | Present (solid line) | — | — | — | 5 | 100 | Present | 0.742 | 12.71 | 2.0 | 5.0 | 1 | 2.7 |
| Comparative Example 6 | Present (solid line) | — | — | — | 5 | 105 | Present | 0744 | 12.47 | 3.0 | 7.5 | 3 | 8.1 |
| Comparative Example 7 | Present (solid line) | — | — | — | 5 | 110 | Present | 0.745 | 12.35 | 6.0 | 15.0 | 4 | 10.8 |

As shown in Table 1, in the base steel sheet of Comparative Example 1 in which the magnetic domain control was not performed, although the minimum number of fractures was 37 and there was no problem in the repeated bendability, the iron loss value was as extremely high as 0.85 W/kg. In addition, in the grain-oriented electrical steel sheet of Comparative Example 2 in which magnetic domain control was performed by forming continuous (solid line-shaped) grooves in the direction perpendicular to the rolling direction at intervals of 5 mm, although the iron loss improvement amount was as high as 14.12% and there was no problem, the minimum number of fractures ratio was 2.7%, and the repeated bendability was extremely poor. In addition, in the grain-oriented electrical steel sheet of Comparative Example 3 in which magnetic domain control was performed by forming solid line-shaped grooves in a direction perpendicular (90°) to the rolling direction at intervals of 2.5 mm, the iron loss improvement amount was deteriorated to 7.06%. Therefore, it is considered that the effect of improving the iron loss is optimal in a case where the grooves are formed at intervals of 5 mm.

As shown in Comparative Examples 3 to 7, in a case where solid line-shaped grooves were formed at angles of 95° (85°), 100° (80°), 105° (75°), and 110° (70°) with respect to the rolling direction for the purpose of improving repeated bendability, in the steel sheet of Comparative Example 6 in which the solid line-shaped grooves were formed at an angle of 105°, the iron loss improvement amount was 12.47% and the minimum number of fractures ratio was 8.1%, indicating the best balance between iron loss and repeated bendability. However, it could not be said that the steel sheet is sufficient for manufacturing a wound iron core.

TABLE 2

| | Magnetic domain control | Length of groove (mm) | Length of non-groove (mm) | Ratio of length of groove to length of non-groove | Interval between solid lines or broken lines (mm) | Angle (°) | Overlap | Iron loss W17/50 (W/Kg) | Iron loss improvement amount (%) | Repeated bending test: Average number of fractures | Repeated bending test: Average number of fractures ratio (%) | Repeated bending test: Minimum number of fractures | Repeated bending test: Minimum number of fractures ratio (%) |
|---|---|---|---|---|---|---|---|---|---|---|---|---|---|
| Comparative Example 8 | Present (broken line) | 15 | 15 | 1:1 | 2 | 90 | Absent | 0.730 | 14.12 | 2.0 | 5.0 | 2 | 5.4 |
| Example 1 | Present (broken line) | 10 | 10 | 1:1 | 2 | 90 | Absent | 0.730 | 14.12 | 4.2 | 10.5 | 3 | 8.1 |
| Example 2 | Present (broken line) | 7.5 | 7.5 | 1:1 | 2 | 90 | Absent | 0.730 | 14.12 | 5.6 | 14.0 | 4 | 10.8 |
| Example 3 | Present (broken line) | 5 | 5 | 1:1 | 2 | 90 | Absent | 0.730 | 14.12 | 6.3 | 15.8 | 5 | 13.5 |

Contrary to this, as shown in Table 2, in the grain-oriented electrical steel sheets in which the magnetic domain control was performed by forming broken lines at intervals of 2 mm so as to cause the ratio of the length of the groove to the length of the non-groove to be 1:1 in the direction perpendicular to the rolling direction, in the grain-oriented electrical steel sheets of Examples 1 to 3 in which the length of the grooves was in a range of 5 to 10 mm, the iron loss improvement amount was 14.12% and the minimum number of fractures ratio was 8.1% or more, indicating that it became clear that a steel sheet having a better balance than that of the steel sheet of Comparative Example 6 could be obtained.

TABLE 3

| | Magnetic domain control | Length of groove (mm) | Length of non-groove (mm) | Ratio of length of groove to length of non-groove | Interval between solid lines or broken lines (mm) | Angle (°) | Overlap | Iron loss W17/50 (W/Kg) | Iron loss improvement amount (%) | Repeated bending test: Average number of fractures | Repeated bending test: Average number of fractures ratio (%) | Repeated bending test: Minimum number of fractures | Repeated bending test: Minimum number of fractures ratio (%) |
|---|---|---|---|---|---|---|---|---|---|---|---|---|---|
| Comparative Example 9 | Present (broken line) | 10 | 40 | 1:4 | 2 | 90 | Absent | 0.820 | 3.53 | 8.2 | 20.5 | 8 | 21.6 |
| Comparative Example 10 | Present (broken line) | 10 | 30 | 1:3 | 2 | 90 | Absent | 0.799 | 6.00 | 6.4 | 16.0 | 6 | 16.2 |
| Comparative Example 11 | Present (broken line) | 10 | 20 | 1:2 | 2 | 90 | Absent | 0.763 | 10.24 | 4.0 | 10.0 | 3 | 8.1 |

TABLE 3-continued

| | Magnetic domain control | Length of groove (mm) | Length of non-groove (mm) | Ratio of length of groove to length of non-groove | Interval between solid lines or broken lines (mm) | Angle (°) | Overlap | Iron loss W17/50 (W/Kg) | Iron loss improvement amount (%) | Repeated bending test: Average number of fractures | Average number of fractures ratio (%) | Minimum number of fractures | Minimum number of fractures ratio (%) |
|---|---|---|---|---|---|---|---|---|---|---|---|---|---|
| Comparative Example 12 | Present (broken line) | 10 | 20 | 1:1.5 | 9 | 90 | Absent | 0.748 | 12.00 | 3.8 | 9.5 | 3 | 8.1 |
| Example 4 | Present (broken line) | 10 | 10 | 1:1 | 9 | 90 | Absent | 0.730 | 14.12 | 4.2 | 10.5 | 3 | 8.1 |
| Example 5 | Present (broken line) | 10 | 0.66 | 1.5:1 | 2 | 90 | Minimum | 0.728 | 14.35 | 3.1 | 7.8 | 3 | 8.1 |
| Comparative Example 13 | Present (broken line) | 10 | 5 | 2:1 | 2 | 90 | Minimum | 0.745 | 12.35 | 2.2 | 5.5 | 2 | 5.4 |
| Comparative Example 14 | Present (broken line) | 10 | 0.33 | 3:1 | 2 | 90 | Minimum | 0.774 | 8.94 | 0.9 | 2.3 | 0 | 0.0 |
| Comparative Example 15 | Present (broken line) | 10 | 40 | 1:4 | 2.5 | 90 | Absent | 0.833 | 2.00 | 8.8 | 22.0 | 8 | 21.6 |
| Comparative Example 16 | Present (broken line) | 10 | 30 | 1:3 | 2.5 | 90 | Absent | 0.815 | 4.12 | 6.7 | 16.8 | 6 | 16.2 |
| Comparative Example 17 | Present (broken line) | 10 | 20 | 1:2 | 2.5 | 90 | Absent | 0.774 | 8.94 | 4.3 | 10.8 | 4 | 10.8 |
| Comparative Example 18 | Present (broken line) | 10 | 20 | 1:1.5 | 2.5 | 90 | Absent | 0.752 | 11.53 | 4.1 | 10.3 | 4 | 10.8 |
| Example 6 | Present (broken line) | 10 | 10 | 1:1 | 2.5 | 90 | Absent | 0.726 | 14.59 | 3.8 | 9.5 | 3 | 8.1 |
| Example 7 | Present (broken line) | 10 | 0.66 | 1.5:1 | 2.5 | 90 | Minimum | 0.733 | 13.76 | 3.1 | 7.8 | 3 | 8.1 |
| Comparative Example 19 | Present (broken line) | 10 | 5 | 2:1 | 2.5 | 90 | Minimum | 0.758 | 10.82 | 2.4 | 6.0 | 2 | 5.4 |
| Comparative Example 20 | Present (broken line) | 10 | 0.33 | 3:1 | 2.5 | 90 | Minimum | 0.785 | 7.65 | 1.1 | 2.8 | 1 | 2.7 |

Next, as a result of examination of the ratio of the length of the groove to the length of the non-groove, as shown in Table 3, in the grain-oriented electrical steel sheets of Examples 4 to 7 in which the ratio of length of the groove to length of the non-groove was 1:1 to 1.5:1, the iron loss improvement amount was 13.76% or more, and the minimum number of fractures ratio was 8.1% or more, indicating that it became clear that a steel sheet having a better balance than that of the steel sheet of Comparative Example 6 could be obtained.

TABLE 4

| | Magnetic domain control | Length of groove (mm) | Length of non-groove (mm) | Ratio of length of groove to length of non-groove | Interval between solid lines or broken lines (mm) | Angle (°) | Overlap | Iron loss W17/50 (W/Kg) | Iron loss improvement amount (%) | Repeated bending test: Average number of fractures | Repeated bending test: Average number of fractures ratio (%) | Repeated bending test: Minimum number of fractures | Repeated bending test: Minimum number of fractures ratio (%) |
|---|---|---|---|---|---|---|---|---|---|---|---|---|---|
| Comparative Example 21 | Present (broken line) | 7.5 | 7.5 | 1:1 | 1.5 | 90 | Absent | 0.734 | 13.65 | 3.1 | 7.8 | 1 | 2.7 |
| Example 8 | Present (broken line) | 7.5 | 7.5 | 1:1 | 2 | 90 | Absent | 0.730 | 14.12 | 5.6 | 14.0 | 4 | 10.8 |
| Example 9 | Present (broken line) | 7.5 | 7.5 | 1:1 | 2.5 | 90 | Absent | 0.726 | 14.59 | 3.8 | 9.5 | 3 | 8.1 |
| Example 10 | Present (broken line) | 7.5 | 7.5 | 1:1 | 5 | 90 | Absent | 0.729 | 14.24 | 5.5 | 13.8 | 4 | 10.8 |
| Example 11 | Present (broken line) | 7.5 | 7.5 | 1:1 | 10 | 90 | Absent | 0.730 | 14.12 | 6.8 | 17.0 | 5 | 13.5 |
| Example 12 | Present (broken line) | 7.5 | 7.5 | 1:1 | 20 | 90 | Absent | 0.742 | 12.71 | 6.7 | 16.8 | 6 | 16.2 |
| Comparative Example 22 | Present (broken line) | 7.5 | 7.5 | 1:1 | 30 | 90 | Absent | 0.748 | 12.00 | 7.8 | 19.5 | 10 | 27.0 |

Next, as a result of examination of the interval between the adjacent broken lines, as shown in Table 4, in the grain-oriented electrical steel sheets of Examples 8 to 12 in which the interval between the adjacent broken lines was in a range of 2.0 to 20 mm, the iron loss improvement amount was 12.71% or more, and the minimum number of fractures ratio was 8.1% or more, indicating that it became clear that a steel sheet having a better balance than that of the steel sheet of Comparative Example 6 could be obtained.

TABLE 5

| | Magnetic domain control | Length of groove (mm) | Length of non-groove (mm) | Ratio of length of groove to length of non-groove | Interval between solid lines or broken lines (mm) | Angle (°) | Overlap | Iron loss W17/50 (W/Kg) | Iron loss improvement amount (%) | Repeated bending test: Average number of fractures | Repeated bending test: Average number of fractures ratio (%) | Repeated bending test: Minimum number of fractures | Repeated bending test: Minimum number of fractures ratio (%) |
|---|---|---|---|---|---|---|---|---|---|---|---|---|---|
| Example 13 | Present (broken line) | 7.5 | 7.5 | 1:1 | 2 | 90 | Absent | 0.730 | 14.12 | 5.6 | 14.0 | 4 | 10.8 |
| Comparative Example 23 | Present (broken line) | 7.5 | 7.5 | 1:1 | 2 | 90 | Present (5 mm) | 0.77 | 9.41 | 3.1 | 7.8 | 1 | 2.7 |

Next, as a result of examination of the positions of the grooves of the adjacent broken line, as shown in Table 5, in the grain-oriented electrical steel sheet of Example 13 in which the grooves were arranged so as to cause the overlap (the length of overlap) between the grooves of the broken lines adjacent in the direction perpendicular to the broken lines to be zero (minimum), the iron loss improvement amount was 14.12%, and the minimum number of fractures ratio was 10.8%, indicating that it became clear that a steel sheet having a better balance than that of the steel sheet of Comparative Example 6 could be obtained.

TABLE 6

| | Magnetic domain control | Length of groove (mm) | Length of non-groove (mm) | Ratio of length of groove to length of non-groove | Interval between solid lines or broken lines (mm) | Angle (°) | Overlap | Iron loss W17/50 (W/Kg) | Iron loss improvement amount (%) | Repeated bending test: Average number of fractures | Repeated bending test: Average number of fractures ratio (%) | Repeated bending test: Minimum number of fractures | Repeated bending test: Minimum number of fractures ratio (%) |
|---|---|---|---|---|---|---|---|---|---|---|---|---|---|
| Example 14 | Present (broken line) | 7.5 | 7.5 | 1:1 | 2 | 90 | Absent | 0.730 | 14.12 | 5.6 | 14.0 | 4 | 10.8 |
| Example 15 | Present (broken line) | 7.5 | 7.5 | 1:1 | 2 | 95 | Absent | 0.736 | 13.41 | 4.6 | 11.5 | 3 | 8.1 |
| Example 16 | Present (broken line) | 7.5 | 7.5 | 1:1 | 2 | 100 | Absent | 0.742 | 12.71 | 5.9 | 14.8 | 4 | 10.8 |
| Example 17 | Present (broken line) | 7.5 | 7.5 | 1:1 | 2 | 105 | Absent | 0.744 | 12.47 | 7.1 | 17.8 | 5 | 13.5 |
| Comparative Example 24 | Present (broken line) | 7.5 | 7.5 | 1:1 | 2 | 110 | Absent | 0.755 | 11.18 | 10.1 | 25.3 | 8 | 21.6 |

Next, as a result of examination of the angle of the broken lines including the grooves with respect to the rolling direction, as shown in Table 6, in the grain-oriented electrical steel sheets of Examples 14 to 17 in which the angles were in a range of 90° to 105° in the direction perpendicular to the broken lines, the iron loss improvement amount was 12.47% or more, and the minimum number of fractures ratio was 8.1% or more, indicating that it became clear that a steel sheet having a better balance than that of the steel sheet of Comparative Example 6 could be obtained.

TABLE 7

| | Magnetic domain control | Length of groove (mm) | Length of non-groove (mm) | Ratio of length of groove to length of non-groove | Interval between solid lines or broken lines (mm) | Angle (°) | Overlap | Iron loss W17/50 (W/Kg) | Iron loss improvement amount (%) | Repeated bending test: Average number of fractures | Repeated bending test: Average number of fractures ratio (%) | Repeated bending test: Minimum number of fractures | Repeated bending test: Minimum number of fractures ratio (%) |
|---|---|---|---|---|---|---|---|---|---|---|---|---|---|
| Comparative Example 25 | Present (broken line) | 1 | 1 | 1:1 | 2 | 90 | Absent | 0.832 | 2.01 | 1.1 | 2.8 | 1 | 2.7 |
| Comparative Example 26 | Present (broken line) | 2 | 2 | 1:1 | 2 | 90 | Absent | 0.798 | 6.01 | 1.1 | 2.8 | 1 | 2.7 |
| Comparative Example 27 | Present (broken line) | 3 | 3 | 1:1 | 2 | 90 | Absent | 0.787 | 7.62 | 1.1 | 2.8 | 1 | 2.7 |
| Comparative Example 28 | Present (broken line) | 100 | 100 | 1:1 | 2 | 90 | Absent | 0.782 | 7.67 | 2.4 | 6.0 | 2 | 5.4 |

TABLE 7-continued

| | Magnetic domain control | Length of groove (mm) | Length of non-groove (mm) | Ratio of length of groove to length of non-groove | Interval between solid lines or broken lines (mm) | Angle (°) | Overlap | Iron loss W17/50 (W/Kg) | Iron loss improvement amount (%) | Repeated bending test: Average number of fractures | Average number of fractures ratio (%) | Minimum number of fractures | Minimum number of fractures ratio (%) |
|---|---|---|---|---|---|---|---|---|---|---|---|---|---|
| Comparative Example 29 | Present (broken line) | 160 | 160 | 1:1 | 2 | 90 | Absent | 0.789 | 7.65 | 3.1 | 7.8 | 1 | 2.7 |
| Comparative Example 30 | Present (broken line) | 210 | 210 | 1:1 | 2 | 90 | Absent | 0.799 | 6.02 | 3.1 | 7.8 | 1 | 2.7 |

Table 7 shows Comparative Examples 25 to 27 in which the length of the grooves was less than 5 mm and Comparative Examples 28 to 30 in which the length of the grooves was on the order of several hundred mm. In Comparative Examples 25 to 30, the ratio of the length of the groove to the length of the non-groove was 1:1, there was "no" overlap between the grooves (that is, the length of overlap between the grooves was zero), the interval between the grooves was 2 mm, and the angle of the grooves was 90°. As shown in Table 7, it can be seen that in a case where the length of the grooves was extremely short and in a case where the length of the grooves was extremely long, the iron loss improvement ratio and the minimum number of fractures ratio were deteriorated, a grain-oriented electrical steel sheets excellent in both magnetic characteristics and repeated bendability could not be obtained.

From the above results, it became clear that the grain-oriented electrical steel sheet of the present disclosure, which is a grain-oriented electrical steel sheet having 180° domain walls parallel to a rolling direction and including two or more broken lines including grooves having a length in a range of 5 to 10 nm on a straight line intersecting the rolling direction on the surface of the grain-oriented electrical steel sheet, in which, in the broken lines including the grooves, the grooves are arranged at equal intervals, the ratio of the length of the groove to the length of a non-groove is in a range of 1:1 to 1.5:1, the adjacent broken lines including the grooves are parallel and have an interval in a range of 2.0 to 20 mm, and the overlap between the grooves in a direction perpendicular to the broken lines including the grooves is minimum, has both low iron loss and excellent repeated bendability at a high level.

BRIEF DESCRIPTION OF THE REFERENCE SYMBOLS

1 grain-oriented electrical steel sheet
2 bent portion

The invention claimed is:

1. A grain-oriented electrical steel sheet, comprising:

two or more discontinuous broken lines, each broken line having grooves and non-grooves, each of the grooves having a length of 5 to 10 mm, on a straight line intersecting a rolling direction on a steel sheet surface, wherein each of the non-grooves is a region between adjacent grooves on one broken line, and wherein, in each of the broken lines having grooves and non-grooves, the grooves are arranged at equal intervals, and a ratio of the length of each groove to a length of a non-groove is in a range of 1:1 to 1.5:1.

2. The grain-oriented electrical steel sheet according to claim 1, wherein the adjacent broken lines including the grooves are parallel and have an interval in a range of 2.0 to 20 mm, and a relationship between a length A of the groove, a length B of the non-groove, and a length C of an overlap between the grooves in a direction perpendicular to the broken lines including the grooves satisfies Formula (1), $$C=(A-B)/2 \quad \text{Formula (1).}$$

3. The grain-oriented electrical steel sheet according to claim 1, wherein the broken lines including the grooves have an angle in a range of 75° to 105° with respect to the rolling direction.

4. The gain-oriented electrical steel sheet according to claim 2, wherein the broken lines including the grooves have an angle in a range of 75° to 105° with respect to the rolling direction.

* * * * *